US008720728B2

(12) United States Patent
Yang et al.

(10) Patent No.: US 8,720,728 B2
(45) Date of Patent: May 13, 2014

(54) TRASH CAN

(75) Inventors: Frank Yang, Rancho Palos Verdes, CA (US); Joseph Sandor, Santa Ana Heights, CA (US)

(73) Assignee: simplehuman, LLC, Torrance, CA (US)

( * ) Notice: Subject to any disclaimer, the term of this patent is extended or adjusted under 35 U.S.C. 154(b) by 262 days.

(21) Appl. No.: 12/045,641

(22) Filed: Mar. 10, 2008

(65) Prior Publication Data

US 2008/0237234 A1 Oct. 2, 2008

Related U.S. Application Data

(60) Provisional application No. 60/906,071, filed on Mar. 9, 2007.

(51) Int. Cl.
*B65D 1/16* (2006.01)

(52) U.S. Cl.
USPC ..... 220/324; 220/264; 220/908

(58) Field of Classification Search
USPC ..... 220/675, 323, 262, 810, 263, 324, 908, 220/326, 260, 315, 264, 827
See application file for complete search history.

(56) References Cited

U.S. PATENT DOCUMENTS

| | | | |
|---|---|---|---|
| 1,426,211 | A | 8/1922 | Pausin |
| 1,461,253 | A | 7/1923 | Owen |
| 1,754,802 | A | 4/1930 | Raster |
| 1,820,555 | A | 8/1931 | Buschman |
| 1,891,651 | A | 12/1932 | Padelford et al. |
| 1,922,729 | A | 8/1933 | Giebel |
| 1,980,938 | A | 11/1934 | Geibel |
| D148,825 | S | 2/1948 | Snider |
| 2,457,274 | A | 12/1948 | Rifken |
| 2,759,625 | A | 8/1956 | Ritter |
| 2,888,307 | A | 5/1959 | Graves et al. |
| 2,946,474 | A | 7/1960 | Knapp |

(Continued)

FOREIGN PATENT DOCUMENTS

| | | |
|---|---|---|
| AU | 622536 | 4/1992 |
| CA | 2519295 | 3/2007 |

(Continued)

OTHER PUBLICATIONS

European Search Report for European Application No. EP 06010394, dated Aug. 27, 2006, in 1 page.

(Continued)

*Primary Examiner* — Jeffrey Allen
(74) *Attorney, Agent, or Firm* — Knobbe Martens Olson & Bear LLP

(57) ABSTRACT

A trash can with a lid can include a lock for the lid. The lock can include a latch that cooperates with the trash container body to lock the lid over the opening of the body. The latch can be configured to slide with respect to the edge of the opening of the body from an unlocked position to a locked position. This latch can be integrated into, built into or self contained in the lid. The trash can can also include a pedal actuator for opening the lid. The trash can can also include a damping mechanism mounted to the body of the trash can with a mounting plate. The mounting plate can be made from a material that is harder than the material used for the body of the trash can. Additionally, the trash can can have wheels.

24 Claims, 17 Drawing Sheets

(56) References Cited

U.S. PATENT DOCUMENTS 3,008,604 A 11/1961 Garner
3,023,922 A 3/1962 Arrington et al.
3,137,408 A 6/1964 Taylor
3,654,534 A 4/1972 Fischer
3,820,200 A 6/1974 Myers
3,825,150 A 7/1974 Taylor
3,825,215 A 7/1974 Borglum
3,886,425 A 5/1975 Weiss
3,891,115 A 6/1975 Ono
4,014,457 A 3/1977 Hodge
4,027,774 A 6/1977 Cote
4,081,105 A 3/1978 Dagonnet et al.
4,189,808 A 2/1980 Brown
4,200,197 A 4/1980 Meyer et al.
4,217,616 A 8/1980 Jessup
4,303,174 A 12/1981 Anderson
4,320,851 A 3/1982 Montoya
4,357,740 A 11/1982 Brown
4,416,197 A 11/1983 Kehl
4,457,483 A 7/1984 Gagne
4,535,911 A 8/1985 Goulter
4,570,304 A 2/1986 Montreuil et al.
4,576,310 A 3/1986 Isgar et al.
D284,320 S 6/1986 Kubic et al.
4,609,117 A 9/1986 Pamment
4,630,332 A 12/1986 Bisbing
4,630,752 A 12/1986 DeMars
4,664,347 A 5/1987 Brown et al.
4,697,312 A 10/1987 Freyer
4,711,161 A 12/1987 Swin et al.
4,729,490 A 3/1988 Ziegenbein
4,753,367 A 6/1988 Miller et al.
4,763,808 A 8/1988 Guhl et al.
4,765,548 A 8/1988 Sing
4,765,579 A 8/1988 Robbins et al.
4,792,039 A 12/1988 Dayton
4,794,973 A 1/1989 Perisic
4,834,260 A 5/1989 Auten
4,863,053 A 9/1989 Oberg
4,867,339 A 9/1989 Hahn
4,884,717 A 12/1989 Bussard et al.
4,892,224 A 1/1990 Graham
4,913,308 A 4/1990 Culbertson
4,918,568 A 4/1990 Stone et al.
4,923,087 A 5/1990 Burrows
4,948,004 A 8/1990 Chich
4,964,523 A 10/1990 Bieltvedt et al.
4,972,966 A 11/1990 Craft, Jr.
4,996,467 A 2/1991 Day
5,031,793 A 7/1991 Chen et al.
5,048,903 A 9/1991 Loblein
5,054,724 A 10/1991 Hutcheson
5,065,272 A 11/1991 Owen et al.
5,065,891 A 11/1991 Casey
5,090,785 A 2/1992 Stamp
5,100,087 A 3/1992 Ashby
5,111,958 A 5/1992 Witthoeft
D327,760 S 7/1992 Donnelly
D329,929 S 9/1992 Knoedler et al.
5,147,055 A 9/1992 Sampson et al.
5,156,290 A 10/1992 Rodrigues
5,170,904 A 12/1992 Neuhaus
5,174,462 A 12/1992 Hames
D335,562 S 5/1993 Evans
5,213,272 A 5/1993 Gallagher et al.
5,222,704 A 6/1993 Light
5,226,558 A 7/1993 Whitney et al.
5,230,525 A 7/1993 Delmerico et al.
5,242,074 A 9/1993 Conaway et al.
D340,333 S 10/1993 Duran et al.
5,249,693 A 10/1993 Gillispie et al.
5,261,553 A 11/1993 Mueller et al.
5,314,151 A 5/1994 Carter-Mann
5,322,179 A 6/1994 Ting
5,329,212 A 7/1994 Feigleson
5,348,222 A 9/1994 Patey
5,381,588 A 1/1995 Nelson
5,385,258 A 1/1995 Sutherlin
5,390,818 A 2/1995 LaBuda
5,404,621 A 4/1995 Heinke
5,407,089 A 4/1995 Bird et al.
5,419,452 A 5/1995 Mueller et al.
5,471,708 A 12/1995 Lynch
5,474,201 A 12/1995 Liu
5,501,358 A 3/1996 Hobday
5,520,067 A 5/1996 Gaba
5,520,303 A 5/1996 Bernstein et al.
5,531,348 A * 7/1996 Baker et al. ..... 220/264
5,535,913 A 7/1996 Asbach et al.
5,558,254 A 9/1996 Anderson et al.
D377,554 S 1/1997 Adriaansen
5,611,507 A 3/1997 Smith
5,628,424 A 5/1997 Gola
5,632,401 A 5/1997 Hurd
5,636,416 A 6/1997 Anderson
5,644,111 A 7/1997 Cerny et al.
5,645,186 A 7/1997 Powers et al.
5,650,680 A 7/1997 Chula
D383,277 S 9/1997 Peters
5,662,235 A 9/1997 Nieto
5,690,247 A 11/1997 Boover
5,695,088 A 12/1997 Kasbohm
5,699,929 A * 12/1997 Ouno ..... 220/323
D388,922 S 1/1998 Peters
D389,631 S 1/1998 Peters
5,704,511 A 1/1998 Kellams
5,724,837 A 3/1998 Shin
5,730,312 A 3/1998 Hung
5,732,845 A 3/1998 Armaly, Jr.
5,735,495 A 4/1998 Kubota
5,738,239 A 4/1998 Triglia
5,799,909 A 9/1998 Ziegler
5,816,431 A 10/1998 Giannopoulos
5,816,640 A 10/1998 Nishimura
D401,719 S 11/1998 Van Leeuwen et al.
5,873,643 A 2/1999 Burgess, Jr. et al.
5,881,896 A 3/1999 Presnell et al.
5,881,901 A 3/1999 Hampton
5,884,237 A 3/1999 Kanki et al.
5,887,748 A 3/1999 Nguyen
5,967,392 A 10/1999 Niemi et al.
5,987,708 A 11/1999 Newton
6,000,569 A 12/1999 Liu
6,010,024 A 1/2000 Wang
6,024,238 A 2/2000 Jaros
6,036,050 A 3/2000 Ruane
6,102,239 A 8/2000 Wien
6,123,215 A 9/2000 Windle
D431,700 S 10/2000 Roudebush
6,126,031 A 10/2000 Reason
6,129,233 A 10/2000 Schiller
D435,951 S 1/2001 Yang et al.
6,209,744 B1 4/2001 Gill
6,211,637 B1 4/2001 Studer
6,234,339 B1 5/2001 Thomasd
6,250,492 B1 6/2001 Verbeek
D445,980 S 7/2001 Tjugum
6,286,706 B1 9/2001 Tucker
6,328,320 B1 * 12/2001 Walski et al. ..... 280/47.26
6,345,725 B1 2/2002 Lin
6,364,147 B1 4/2002 Meinzinger et al.
6,386,386 B1 5/2002 George
6,390,321 B1 5/2002 Wang
6,401,958 B1 6/2002 Foss et al.
6,519,130 B1 2/2003 Breslow
6,557,716 B1 5/2003 Chan
6,596,983 B2 7/2003 Brent
6,626,316 B2 9/2003 Yang
6,626,317 B2 9/2003 Pfiefer et al.
D482,169 S 11/2003 Lin
6,659,407 B2 12/2003 Asaro
6,681,950 B2 1/2004 Miller, Jr. et al.
D488,604 S 4/2004 Yang et al.
D488,903 S 4/2004 Yang et al.

(56) References Cited

U.S. PATENT DOCUMENTS

D489,503 S 5/2004 Lin
D489,857 S 5/2004 Yang et al.
D490,583 S 5/2004 Yang et al.
D490,954 S 6/2004 Brand
D491,706 S 6/2004 Yang et al.
6,758,366 B2 7/2004 Bourgund et al.
D493,930 S 8/2004 Wang
D494,723 S 8/2004 Lin
6,812,655 B1 11/2004 Wang et al.
6,814,249 B2 11/2004 Lin
6,837,393 B1 1/2005 Kuo
6,857,538 B2 2/2005 Lin
6,859,005 B2 2/2005 Boliver
D503,021 S 3/2005 Yang et al.
6,866,826 B2 * 3/2005 Moore et al. ..... 422/548
6,883,676 B2 4/2005 Lin
D507,090 S 7/2005 Yang et al.
6,920,994 B2 7/2005 Lin
6,974,948 B1 12/2005 Brent
D513,445 S 1/2006 Lin
6,981,606 B2 1/2006 Yang et al.
D517,764 S 3/2006 Wang
D517,767 S 3/2006 Yang et al.
D518,266 S 3/2006 Yang et al.
7,017,773 B2 * 3/2006 Gruber et al. ..... 220/675
7,044,323 B2 5/2006 Yang
D525,756 S 7/2006 Yang et al.
7,073,677 B2 7/2006 Richardson et al.
7,077,283 B2 7/2006 Yang et al.
7,080,750 B2 7/2006 Wein et al.
7,086,550 B2 8/2006 Yang et al.
D528,726 S 9/2006 Lin
7,121,421 B2 10/2006 Yang et al.
D535,799 S 1/2007 Epps
D535,800 S 1/2007 Yang et al.
D537,223 S 2/2007 Lin
D537,599 S 2/2007 Lin
D537,601 S 2/2007 Lin
D537,999 S 3/2007 Lin
D538,995 S 3/2007 Lin
D539,498 S 3/2007 Yang et al.
D539,499 S 3/2007 Yang et al.
D540,001 S 4/2007 Zimmerman
D542,001 S 5/2007 Yang et al
D542,995 S 5/2007 Lin
D544,170 S 6/2007 Lin
D544,171 S 6/2007 Lin
D544,671 S 6/2007 Saunders et al.
D545,024 S 6/2007 Liao
7,225,943 B2 6/2007 Yang et al.
D547,020 S 7/2007 Chen
7,243,811 B1 7/2007 Ramsey
D550,918 S 9/2007 Wang et al.
D552,321 S 10/2007 Yang et al.
D552,823 S 10/2007 Yang et al.
D552,824 S 10/2007 Zimmerman
D552,825 S 10/2007 Yang et al.
D559,494 S 1/2008 Yang et al.
D559,495 S 1/2008 Yang et al.
7,328,842 B2 2/2008 Wagner et al.
D564,169 S 3/2008 Wang
D566,367 S 4/2008 Lin
D566,369 S 4/2008 Shek
D566,923 S 4/2008 Lin
7,374,060 B2 5/2008 Yang et al.
7,404,499 B1 7/2008 Ramsey
D576,371 S 9/2008 Zimmerman
D578,266 S 10/2008 Yang et al.
D578,722 S 10/2008 Yang et al.
7,438,199 B1 10/2008 Tidrick
D580,120 S 11/2008 Lin
D580,613 S 11/2008 Yang et al.
D580,615 S 11/2008 Yang et al.
D585,618 S 1/2009 Yang et al.
7,494,021 B2 2/2009 Yang et al.
7,540,396 B2 6/2009 Yang et al.
7,543,716 B2 6/2009 Lin
7,559,433 B2 7/2009 Yang et al.
D603,119 S 10/2009 Yang et al.
7,607,552 B2 10/2009 Efstathiou
7,621,420 B2 11/2009 Bandoh et al.
7,656,109 B2 2/2010 Yang et al.
D611,216 S 3/2010 Yang et al.
D611,671 S 3/2010 Yang et al.
7,694,838 B2 4/2010 Yang et al.
7,703,622 B1 4/2010 Bynoe
D615,722 S 5/2010 Yang et al.
7,712,285 B2 5/2010 Stravitz et al.
7,741,801 B2 6/2010 Fukuizumi
7,748,556 B2 7/2010 Yang et al.
7,781,995 B2 8/2010 Yang et al.
7,806,285 B2 10/2010 Yang et al.
D631,221 S 1/2011 Yang et al.
D632,864 S 2/2011 Yang et al.
D634,911 S 3/2011 Yang et al.
7,896,187 B2 3/2011 Haibel
7,922,024 B2 4/2011 Yang et al.
7,950,543 B2 5/2011 Yang et al.
D644,390 S 8/2011 Smeets et al.
7,992,742 B1 8/2011 Kim
8,006,857 B2 8/2011 Lin
8,074,833 B2 12/2011 Yang et al.
8,136,688 B2 3/2012 Lee et al.
D657,108 S 4/2012 Yang et al.
D657,109 S 4/2012 Liao
D672,520 S 12/2012 Yang et al.
D675,802 S 2/2013 Yang et al.
D675,803 S 2/2013 Yang et al.
8,418,869 B2 4/2013 Yang et al.
8,567,630 B2 10/2013 Yang et al.
8,569,980 B2 10/2013 Yang et al.
2001/0002690 A1 6/2001 Rosky
2002/0079315 A1 6/2002 Yang
2002/0092853 A1 7/2002 Wang
2002/0096524 A1 7/2002 Hardesty
2002/0104266 A1 8/2002 Ranaudo
2003/0089719 A1 5/2003 Berger
2003/0201265 A1 10/2003 Lin
2003/0201267 A1 10/2003 Yang et al.
2003/0230576 A1 * 12/2003 Lin ..... 220/263
2004/0004080 A1 1/2004 Yang et al.
2004/0016756 A1 1/2004 Lin
2004/0020927 A1 2/2004 Yang et al.
2004/0140782 A1 7/2004 Okabe et al.
2004/0164077 A1 8/2004 Kuo
2004/0174268 A1 9/2004 Scott et al.
2004/0175303 A1 9/2004 Lin
2004/0199401 A1 10/2004 Wagner
2004/0200938 A1 10/2004 Forlivio
2004/0206758 A1 10/2004 Lin
2004/0206760 A1 10/2004 Gagnebin
2004/0251746 A1 12/2004 Ichimaru et al.
2005/0017006 A1 1/2005 Kuo
2005/0017010 A1 1/2005 Siegel et al.
2005/0103788 A1 5/2005 Yang et al.
2005/0133506 A1 * 6/2005 Yang et al. ..... 220/263
2005/0230397 A1 10/2005 Yang et al.
2005/0258794 A1 11/2005 Fukuizumi
2006/0027579 A1 2/2006 Yang et al.
2006/0056741 A1 3/2006 Yang et al.
2006/0103086 A1 * 5/2006 Niemeyer et al. ..... 280/47.26
2006/0175336 A1 8/2006 Wang
2006/0186121 A1 8/2006 Yang et al.
2006/0196874 A1 9/2006 Yang
2006/0226149 A1 10/2006 Yang et al.
2006/0249510 A1 11/2006 Lin
2006/0255033 A1 11/2006 Yang et al.
2006/0261071 A1 11/2006 Yang et al.
2006/0278643 A1 12/2006 Chiou
2007/0012699 A1 1/2007 Yang et al.
2007/0034334 A1 2/2007 Ramsey et al.
2007/0090112 A1 4/2007 Kalman et al.
2007/0114847 A1 5/2007 Ichimaru et al.
2007/0181579 A1 8/2007 Kuo et al.

(56) References Cited

U.S. PATENT DOCUMENTS

| | | | |
|---|---|---|---|
| 2007/0182551 | A1 | 8/2007 | Yang et al. |
| 2007/0205195 | A1 | 9/2007 | Yang et al. |
| 2007/0241109 | A1 | 10/2007 | Lin |
| 2007/0266637 | A1 | 11/2007 | McGowan |
| 2007/0272691 | A1 | 11/2007 | Wang et al. |
| 2007/0289972 | A1 | 12/2007 | Wynn et al. |
| 2008/0011754 | A1 | 1/2008 | Ramsey |
| 2008/0011910 | A1 | 1/2008 | Ramsey |
| 2008/0083756 | A1 | 4/2008 | Daniels |
| 2008/0164257 | A1 | 7/2008 | Boll et al. |
| 2008/0236275 | A1 | 10/2008 | Breed et al. |
| 2008/0237234 | A1 | 10/2008 | Yang et al. |
| 2008/0257889 | A1 | 10/2008 | Kovacevich et al. |
| 2008/0257890 | A1 | 10/2008 | Kovacevich et al. |
| 2008/0257891 | A1 | 10/2008 | Kovacevich et al. |
| 2008/0264948 | A1 | 10/2008 | Kovacevich et al. |
| 2008/0264950 | A1 | 10/2008 | Kovacevich et al. |
| 2008/0272119 | A1 | 11/2008 | Efstathiou |
| 2008/0272127 | A1 | 11/2008 | Kovacevich et al. |
| 2009/0084788 | A1 | 4/2009 | Yang et al. |
| 2009/0194532 | A1 | 8/2009 | Yang et al. |
| 2009/0230131 | A1 | 9/2009 | McDuffie et al. |
| 2009/0261105 | A1 | 10/2009 | Cunningham et al. |
| 2009/0266836 | A1 | 10/2009 | Mobley |
| 2010/0006572 | A1 | 1/2010 | Chiou |
| 2010/0170904 | A1 | 7/2010 | Kalman et al. |
| 2010/0237074 | A1 | 9/2010 | Yang et al. |
| 2011/0139781 | A1 | 6/2011 | Jin et al. |
| 2011/0220646 | A1 | 9/2011 | Yang et al. |
| 2011/0220647 | A1 | 9/2011 | Yang et al. |
| 2011/0220648 | A1 | 9/2011 | Yang et al. |
| 2011/0220655 | A1 | 9/2011 | Yang et al. |
| 2013/0233853 | A1 | 9/2013 | Yang et al. |
| 2013/0233857 | A1 | 9/2013 | Yang et al. |
| 2013/0248532 | A1 | 9/2013 | Yang et al. |

FOREIGN PATENT DOCUMENTS

| | | | |
|---|---|---|---|
| CA | 132181 | | 6/2010 |
| CA | 136938 | | 5/2011 |
| CA | 141819 | | 4/2012 |
| CA | 146601 | | 2/2013 |
| CN | 102190144 | A | 9/2011 |
| CN | 301947175 | S | 6/2012 |
| DE | 1610087 | | 6/1950 |
| DE | 1610087 | | 7/1950 |
| DE | 1283741 | | 7/1966 |
| DE | 8436939 | | 3/1985 |
| DE | 9108341 | | 10/1991 |
| DE | 4225936 | A1 | 2/1994 |
| DE | 19525885 | | 3/1997 |
| DE | 19809331 | | 5/1999 |
| DE | 29918687 | | 3/2000 |
| DE | 19933180 | | 1/2001 |
| DE | 10148997 | | 4/2003 |
| DE | 20217561 | | 3/2004 |
| EP | 0582240 | | 7/1993 |
| EP | 0903305 | A1 | 3/1999 |
| EP | 0906876 | A2 | 4/1999 |
| EP | 1094017 | | 4/2001 |
| EP | 1136393 | | 4/2001 |
| EP | 1361176 | | 11/2003 |
| EP | 1447342 | A2 | 8/2004 |
| EP | 1600373 | A2 | 11/2005 |
| EP | 1647503 | A1 | 4/2006 |
| EP | 1686073 | A1 | 8/2006 |
| EP | 1918223 | A1 | 5/2008 |
| EP | 1700799 | B1 | 8/2009 |
| EP | 001164826-0001 | | 9/2009 |
| EP | 001232904-0001 | | 10/2010 |
| EP | 001908575-0001 | | 8/2011 |
| EP | 001317416-0001 | | 4/2012 |
| EP | 001317416-0002 | | 4/2012 |
| EP | 001335285-0001 | | 7/2012 |
| EP | 001335293-0001 | | 7/2012 |
| EP | 2636611 | A1 | 9/2013 |
| EP | 2636613 | A1 | 9/2013 |
| FR | 2887152 | | 12/2006 |
| GB | 191004921 | | 6/1910 |
| GB | 2384418 | | 7/2003 |
| JP | 02-152670 | | 6/1990 |
| JP | H06-56011 | | 8/1994 |
| JP | 06-272888 | | 9/1994 |
| JP | D1300450 | | 5/2007 |
| JP | D1300451 | | 5/2007 |
| JP | D1322056 | | 2/2008 |
| KR | 3003841370000 | | 6/2005 |
| KR | 3004095430000 | | 3/2006 |
| KR | 3004095430001 | | 7/2006 |
| NL | 6908550 | | 12/1970 |
| TW | D112733 | | 9/2006 |
| TW | D129485 | | 7/2009 |
| TW | D133382 | | 2/2010 |
| TW | D133678 | | 3/2010 |
| TW | D147147 | | 5/2012 |
| TW | D154797 | | 7/2013 |
| WO | WO92/02430 | | 2/1992 |
| WO | WO 2005/080232 | A1 | 9/2005 |
| WO | WO 2006-079263 | | 8/2006 |
| WO | WO 2007/139570 | A2 | 12/2007 |
| WO | WO 2009/114495 | | 9/2009 |

OTHER PUBLICATIONS

Partial European Search Report for Application No. EP 10002273, dated Jul. 2, 2010, in 5 pages.

European Search Report for Application No. EP 10002273, dated Jan. 4, 2011, in 9 pages.

Search Report for Taiwan Design Patent Application No. 097304453, dated Apr. 22, 2009.

Search Report for Taiwan Design Patent Application No. 099304439, dated Jul. 1, 2011, in 1 page.

U.S. Appl. No. 13/783,149, filed Mar. 1, 2013, Yang et al.

U.S. Appl. No. 29/447,313, filed Mar. 1, 2013, Yang et al.

Trento Corner 23 Trash Can, Hailo product brochure. http://www.hailo.de/html/default.asp?site=12_71_107&lang=en, May 13, 2008.

* cited by examiner

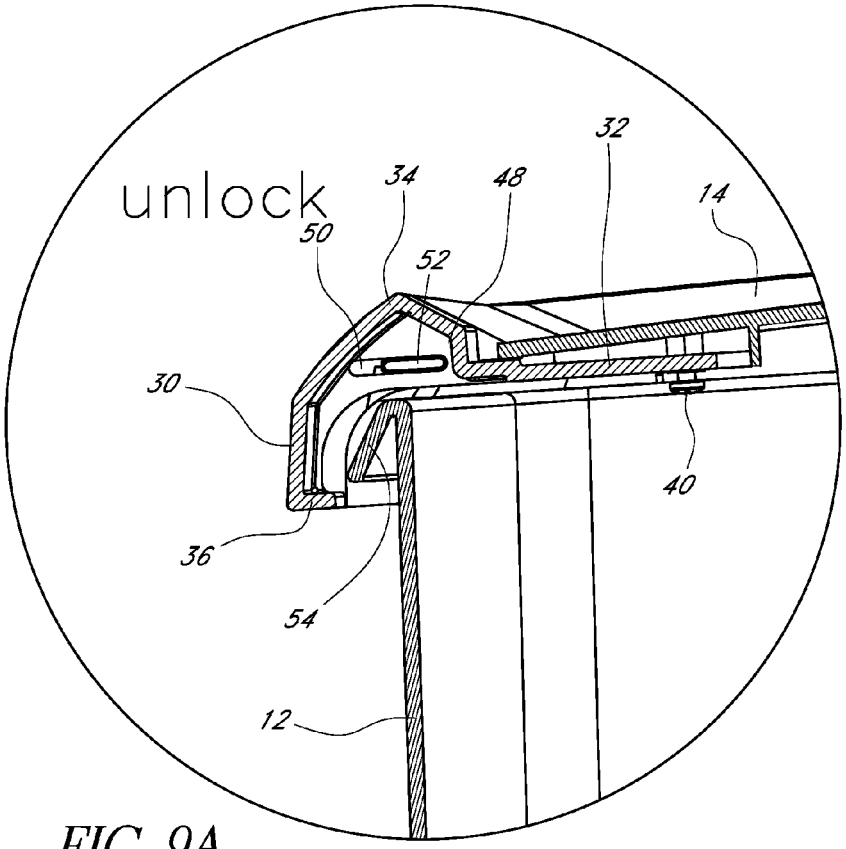
FIG. 9A
FIG. 9B
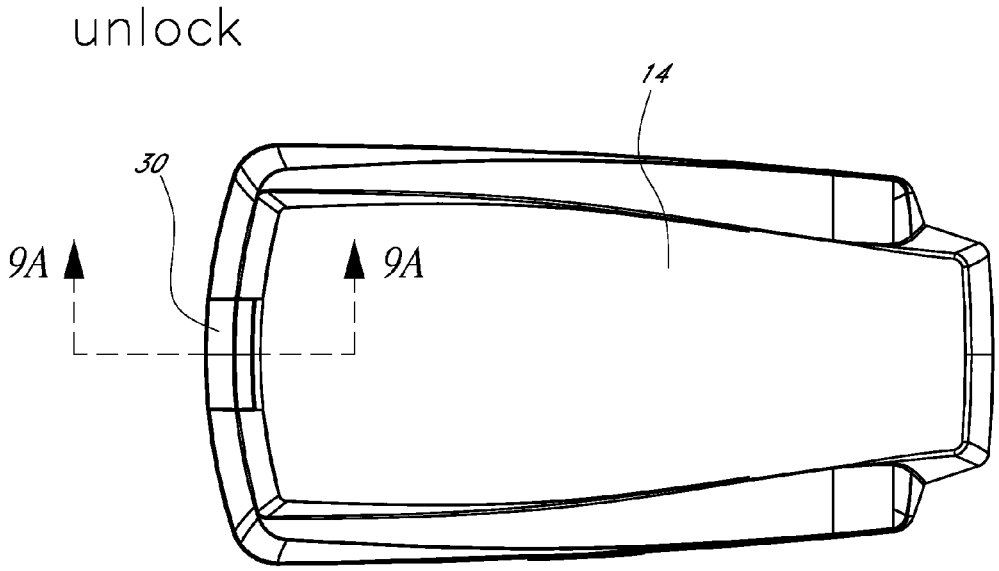

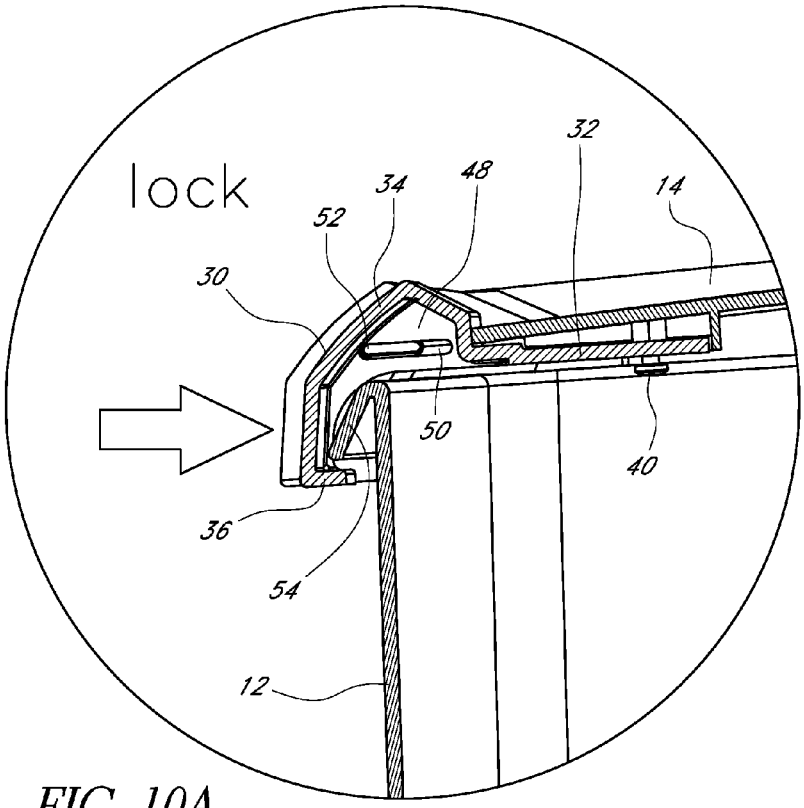
FIG. 10A
FIG. 10B
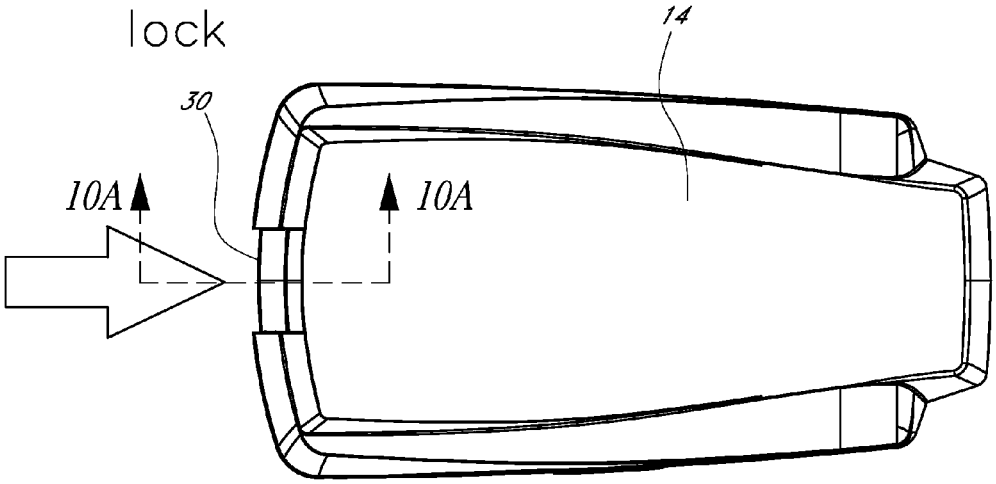

TRASH CAN

PRIORITY INFORMATION

This application is based on a claims priority to the U.S. Provisional Patent Application No. 60/906,071 Mar. 9, 2007, the entire contents of which is hereby incorporated by reference.

BACKGROUND OF THE INVENTIONS

1. Field of the Inventions

The present inventions are directed to lid mechanisms, such as those for trash containers.

2. Description of the Related Art

Receptacles and other devices having lids or doors are used in a variety of different settings. For example, in both residential and commercial settings, trash cans and other devices often have lids or doors for protecting or preventing the escape of the contents of the receptacle. In the context of trash cans, some trash cans include lids or doors to prevent odors from escaping and to hide the trash within the receptacle from view. Additionally, the lid of a trash can help prevent contamination from escaping from the receptacle.

Recently, trash cans with rotary-type motion dampers for slowing the motion of the lids have become commercially available. More specifically, these rotary dampening mechanisms are connected to the lids of the trash cans so as to slow the closing movement of the lids. As such, the trash can is more aesthetically pleasing because the lid closes slowly, thereby preventing a loud slamming noise when the lid is moved to a closing position.

These types of trash cans often are pedal-actuated, i.e., they include a foot pedal which is connected to the lid for moving the lid toward the open position. The rotary mechanisms are connected to the internal linkage connecting the foot pedal to the lid so as to slow the closing movement of the lid.

SUMMARY OF THE INVENTIONS

An aspect of at least on the embodiments disclosed herein includes the realization that including locking mechanism on the lid of a trash can can overcome certain problems associated with trash can lids. For example, toddlers or pets can accidentally knock over trash cans, thereby allowing the contents to spill out. Aside from accidents, toddlers and pets can also simply decide to explore the contents of the trash container, to their parents' or owners' dismay.

Thus, in accordance with an embodiment, a trash container can comprise a trash can body defining an interior cavity configured to receive trash, the trash can body can have an upper opening through which trash can be inserted into the interior cavity, the trash can body can also including a ledge disposed along at least a portion of an upper periphery of the upper opening, at least a portion of the ledge projecting from a side wall of the trash can body. A lid assembly can be pivotally attached to the trash can body so as to move between opened position and closed positions. The lid assembly can comprise a lid member sized to cover substantially the entire upper opening of the trash can body, at least a portion of the lid member can be spaced from the upper opening when the lid assembly is in the opened position, the lid member covering substantially the entire upper opening when the lid assembly is in the closed position. A latch mechanism can be supported by the lid and can comprise a slidable latch member mounted so as to be slidable relative to the lid member. The latch member can be slidable from a first position in which the latch member engages the ledge so as to lock the lead in the closed position and a second position in which the latch member does not engage the ledge.

Another aspect of at least one of the embodiments disclosed herein includes the realization that when mounting a motion dampening device, such as those used for dampening the motion of a lid of a trash can, to a plastic structure, difficulties can arise in the ability of the plastic material to withstand the forces generated in the vicinity of the dampened device. For example, plastic trash cans are often made from softer, more malleable plastics to allow them to withstand the typical treatment of trash cans (e.g., being overstuffed and deformed by an excess of trash). However, mounting a dampening device to such material presents difficulties in that when large forces are applied to the dampening device, which can be quite small and thus can concentrate such forces, the dampening device can be twisted or moved away from its original position, thereby interfering with the dampening process.

Thus, in accordance with an embodiment, a trash can can comprise a trash can body defining an interior volume configured to receive trash. The trash can body can include an upper opening sized such that trash can be inserted through the upper opening into the interior volume, the trash can body formed from a first material. A lid assembly can be pivotally attached relative to the trash can body so as to be movable between opened and closed positions. The lid assembly can comprise a lid member sized to cover substantially the entire upper opening when the lid assembly is in the closed position. An opening mechanism can be configured to move the lid assembly from the closed to the opened position. A dampening device can be configured to dampen movement of the lid assembly at least from the open position toward the closed position. The dampening device can be mounted to the trash can body with a mounting member, the mounting member made from a second material that is stiffer than the first material.

BRIEF DESCRIPTION OF THE DRAWINGS

These and other features and advantages of the present embodiments will become more apparent upon reading the following detailed description and with reference to the accompanying drawings of the embodiments, in which:

FIG. 9A is a detail sectional view of the step trash can taken along line 9A-9A in FIG. 91B with the lid latch in the unlock position; FIG. 9B is a top view of the lid with the latch in the unlock position.

FIG. 10A is a top view of the step trash can taken along line 10A-10A in FIG. 10B, with the lid latch in the lock position; FIG. 10B is a top view of the lid with the latch in the lock position.

DETAILED DESCRIPTION OF THE PREFERRED EMBODIMENTS

Figure 1:
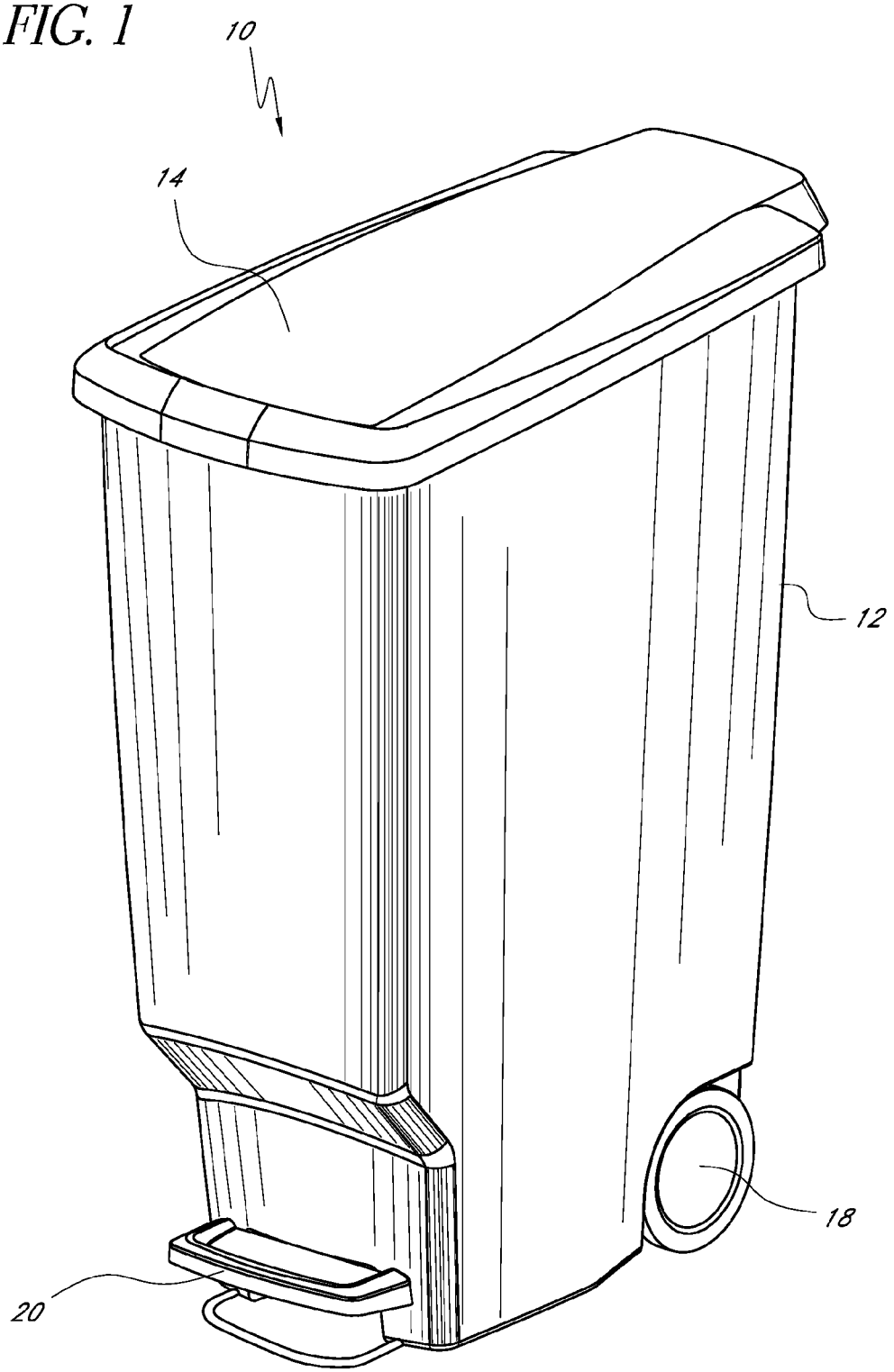
FIG. 1 is a right perspective view of a step trash can in accordance with an embodiment.
Figure 2:
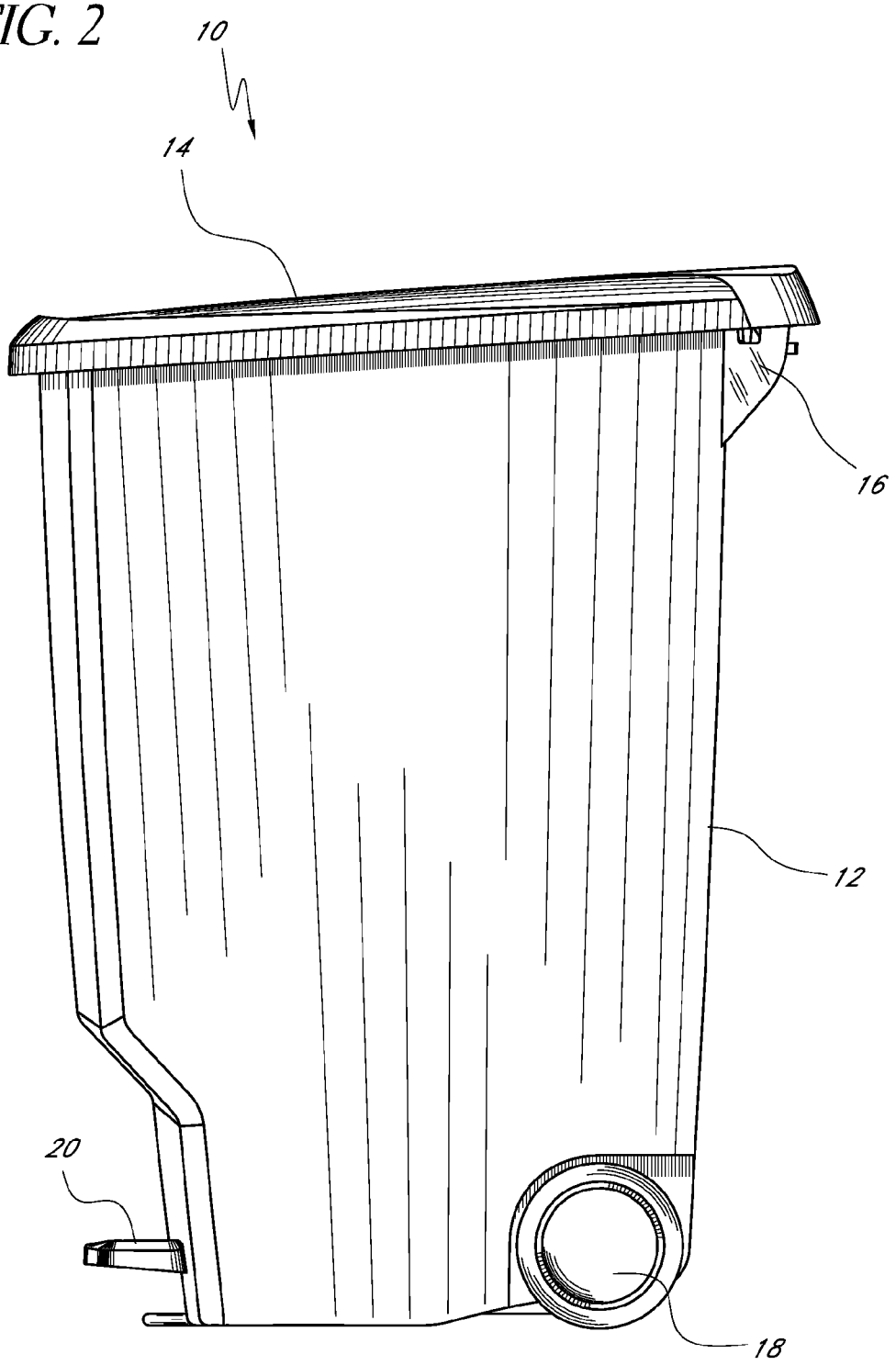
FIG. 2 is a right side view thereof.
Figure 3:
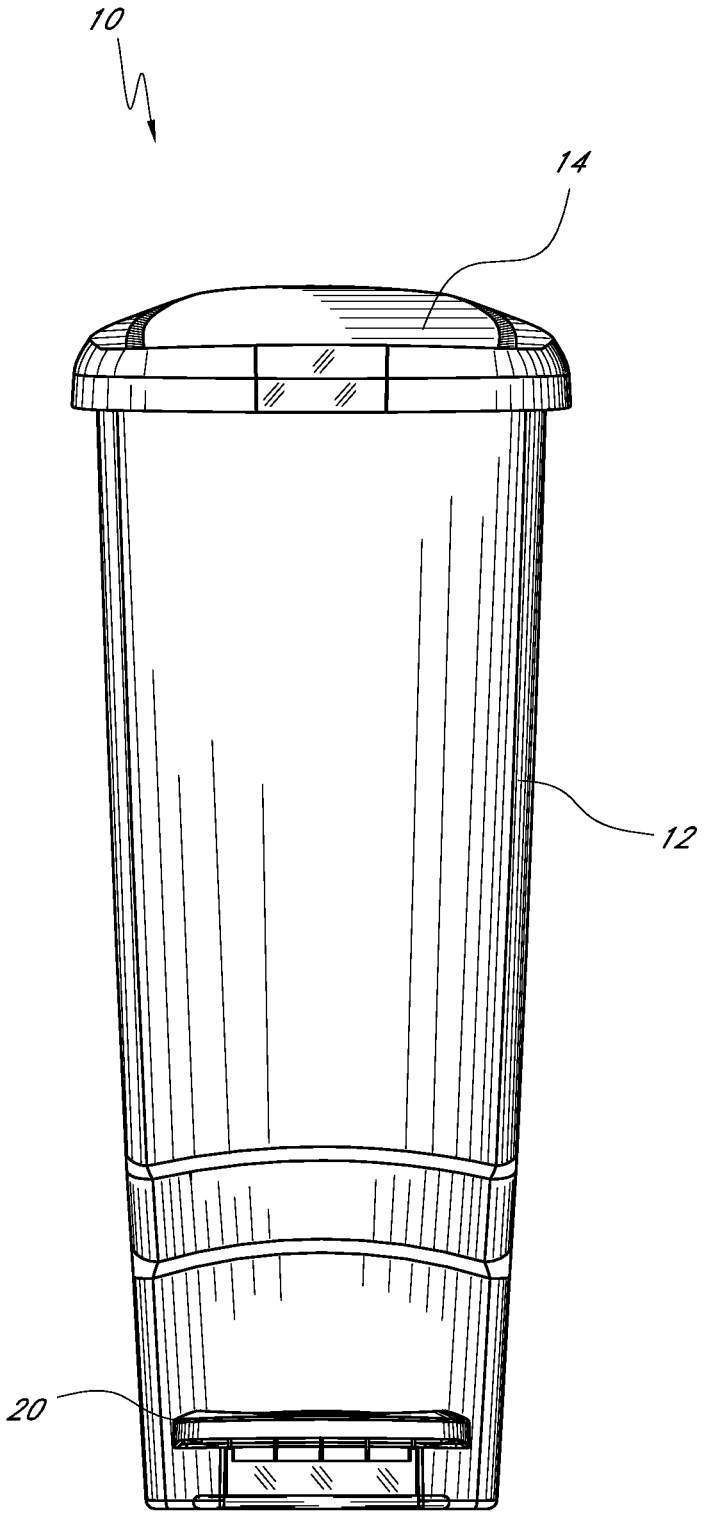
FIG. 3 is a front view thereof.

The inventions disclosed herein are disclosed in the context of a trash can because they have particular utility in this context. However, the inventions disclosed herein can be used in other contexts as well. Further, the inventions are described herein in reference to various embodiments and drawings. It will be appreciated by those skilled in the art that variations and improvements may be accomplished in view of these teachings without deviating from the scope and spirit of the invention. By way of illustration, the present inventions are described in reference to a step-type trash container, or a step trash can of the kind typically used in kitchens, for example. Other types of trash containers, with pivoted lids or removable lids can be used in connection with the present inventions.

With reference to the drawings, a latch can be included on the lid of a trash container, which can latch onto the edge of the trash container body to lock the lid to the edge of the opening of the body, securely covering the opening. FIGS. 1-7 illustrate the external views of a step trash can 10 in accordance with one embodiment of the present invention.

The step trash can 10 can generally have a body 12 and a lid 14 pivotally supported relative to the body. For example, the lid 14 can be hinged to the rear top edge of the body 12, by a hinge 16 shown in FIG. 2. A pair of wheels 18 can be provided to facilitate moving the step trash can 10 along a rolling surface.

A lid actuator system, which can also be referred to as an opening mechanism, can be provided at the rear of the step trash can 10 to activate pivotal opening of the lid 14 (see FIG. 5), the lid actuator system can include a foot piece (or "pedal") 20 located near the front base of the body 12. Linkages 22 (see FIG. 5) and 24 (see FIG. 7) which can include a lever member 24 and lifting rod, described in greater detail below, can cooperate to move the lid to 14 from a closed to an open position. Other than the embodiment of lid actuator system illustrated, other lid actuator system known in the art may be deployed without departing from the scope and spirit of the present inventions. The lid 14 can include a lid latch 30, which can be integrated into, built into or self contained in the lid (as opposed to a separate external locking piece for the lid).

In some embodiments, the latch 30 can be configured to slide with respect to the edge of the opening of the body from an unlocked position to a locked position. The sliding support interface between the latch and the lid can be provided with structures (e.g., indent and complementary locking tabs) that positively index the latch in the locked and unlocked positions. However, other configurations can also be used.

Figure 11:
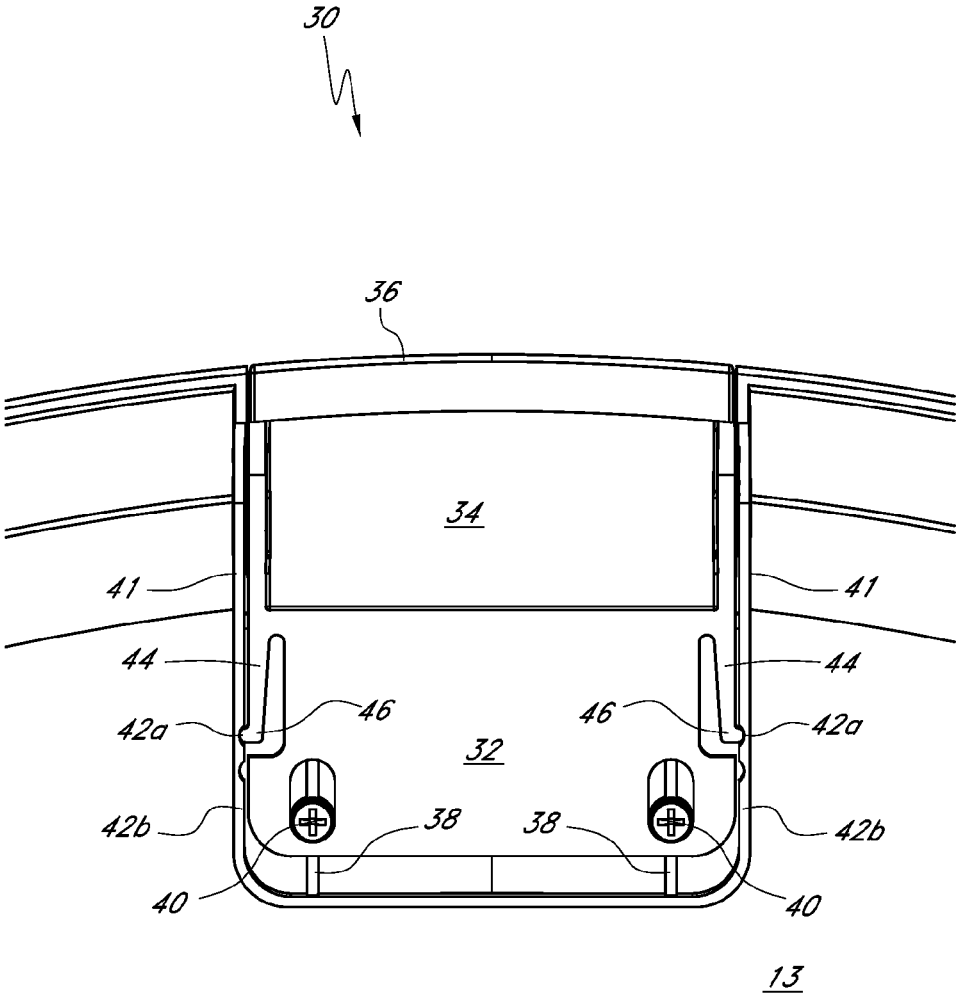
FIG. 11 is a plan view of the underside of the lid with the latch in the unlock position.
Figure 12:
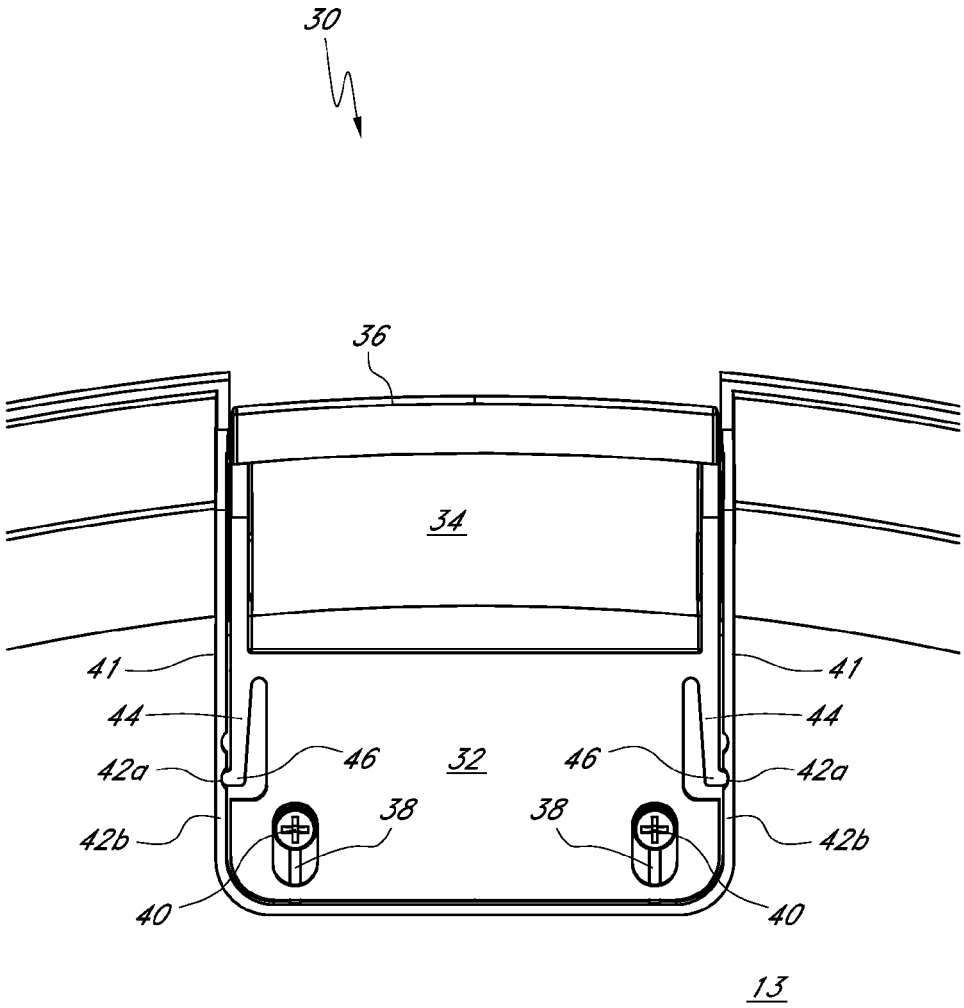
FIG. 12 is a plan view of the underside of the lid with the latch in the lock position.
Figure 13:
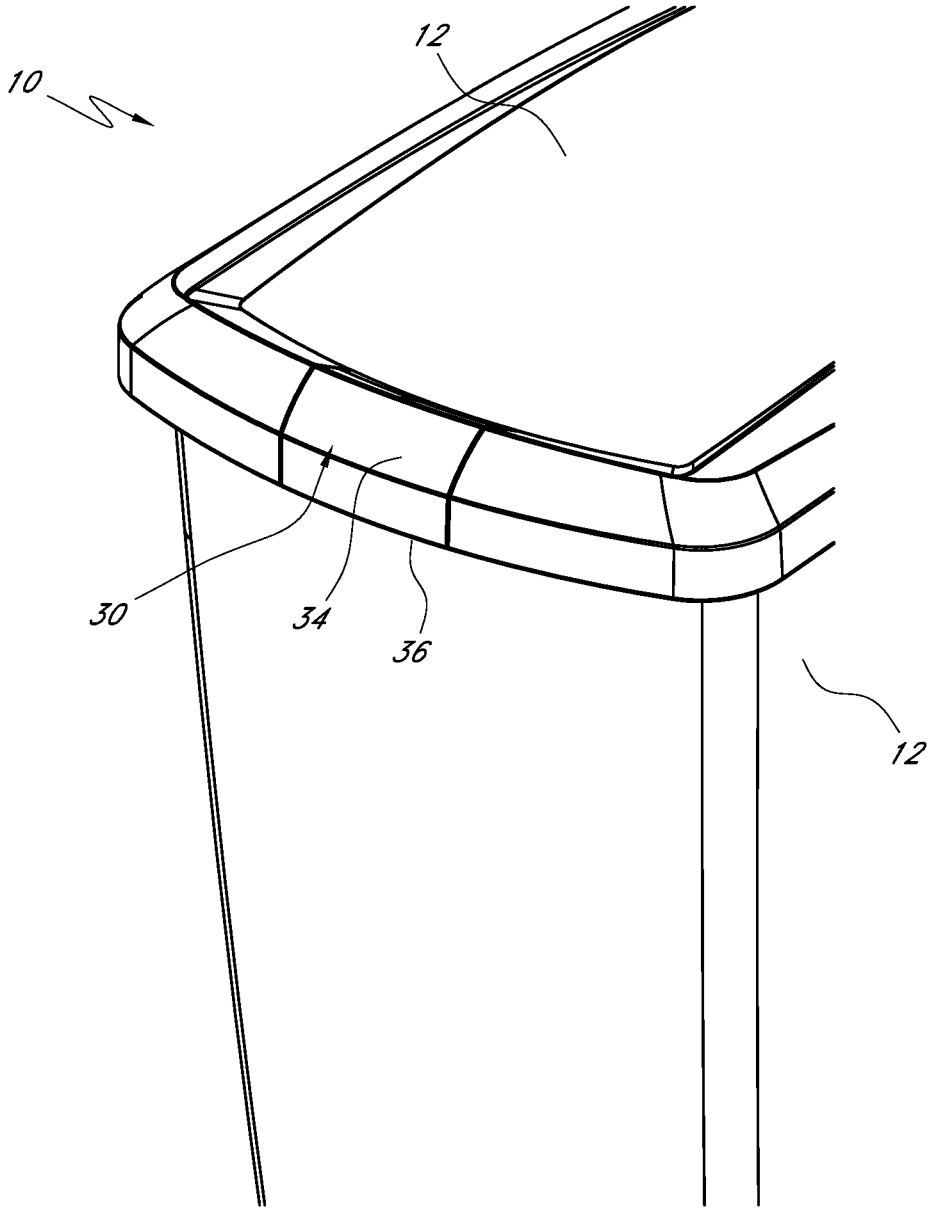
FIG. 13 is a top perspective view of the lid with the latch in the unlock position.
Figure 14:
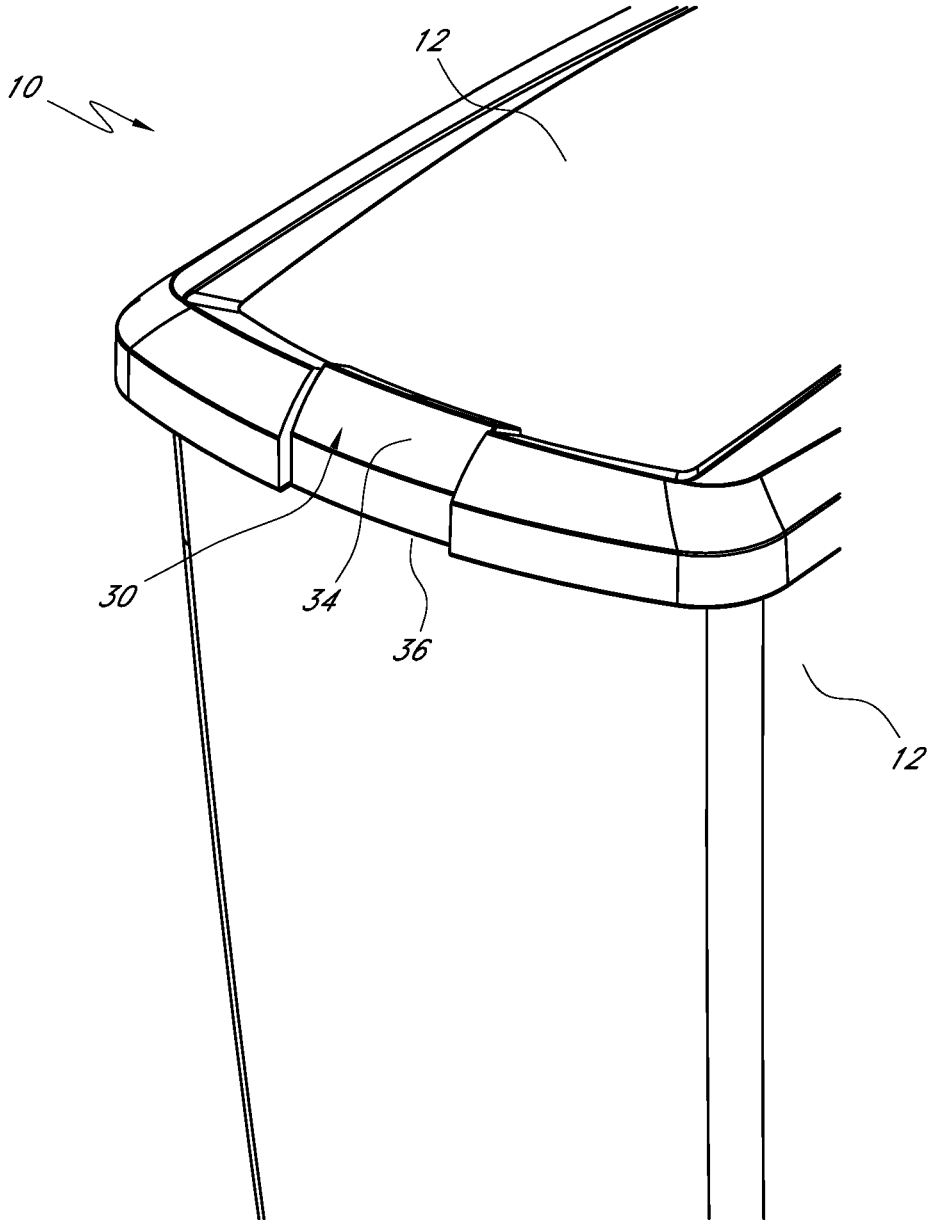
FIG. 14 is a top perspective view of the lid with the latch in the lock position.
Figure 15:
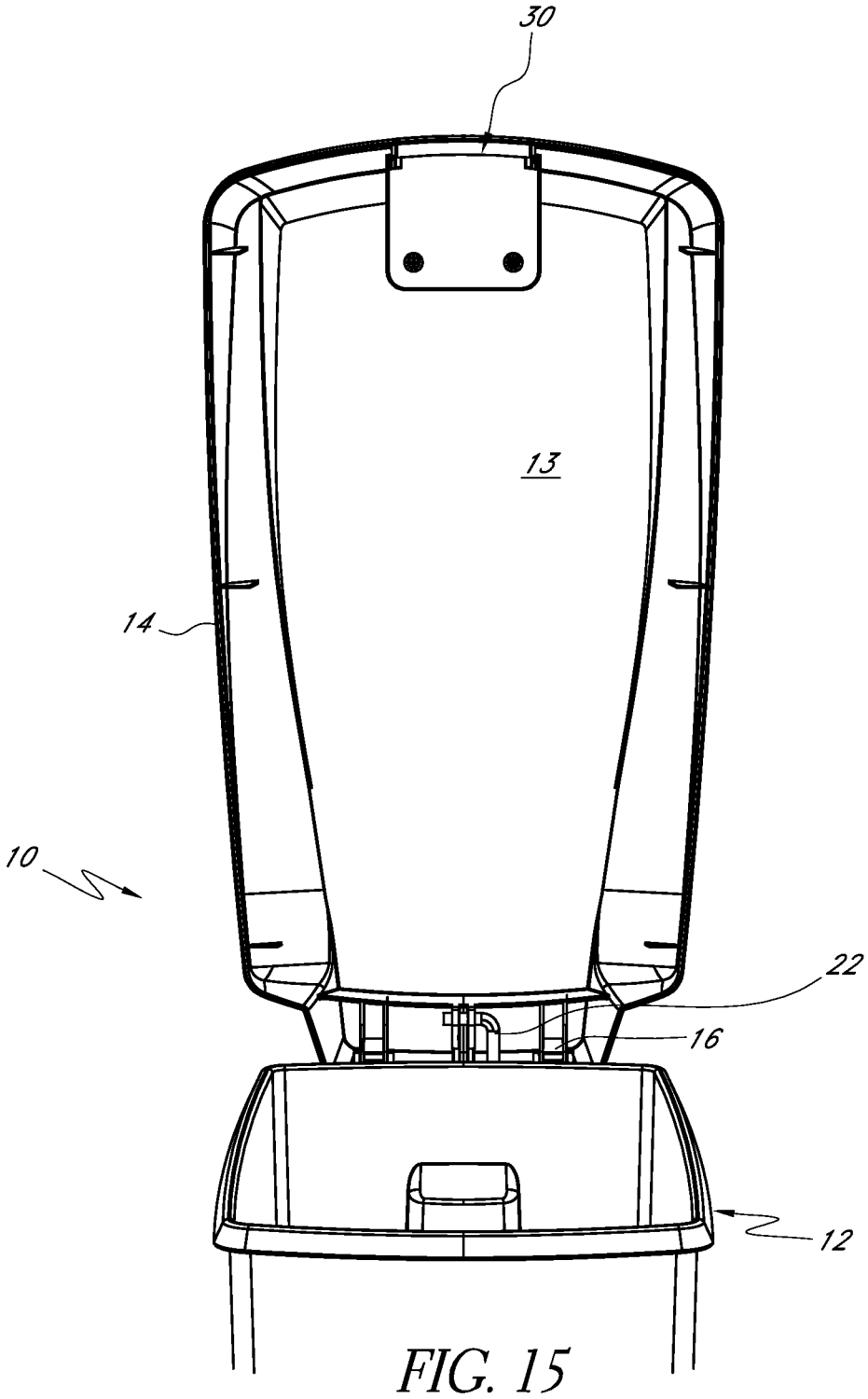
FIG. 15 is a front perspective view of the step trash can with the lid open, showing the underside of the lid with the latch in the unlock position.
Figure 16:
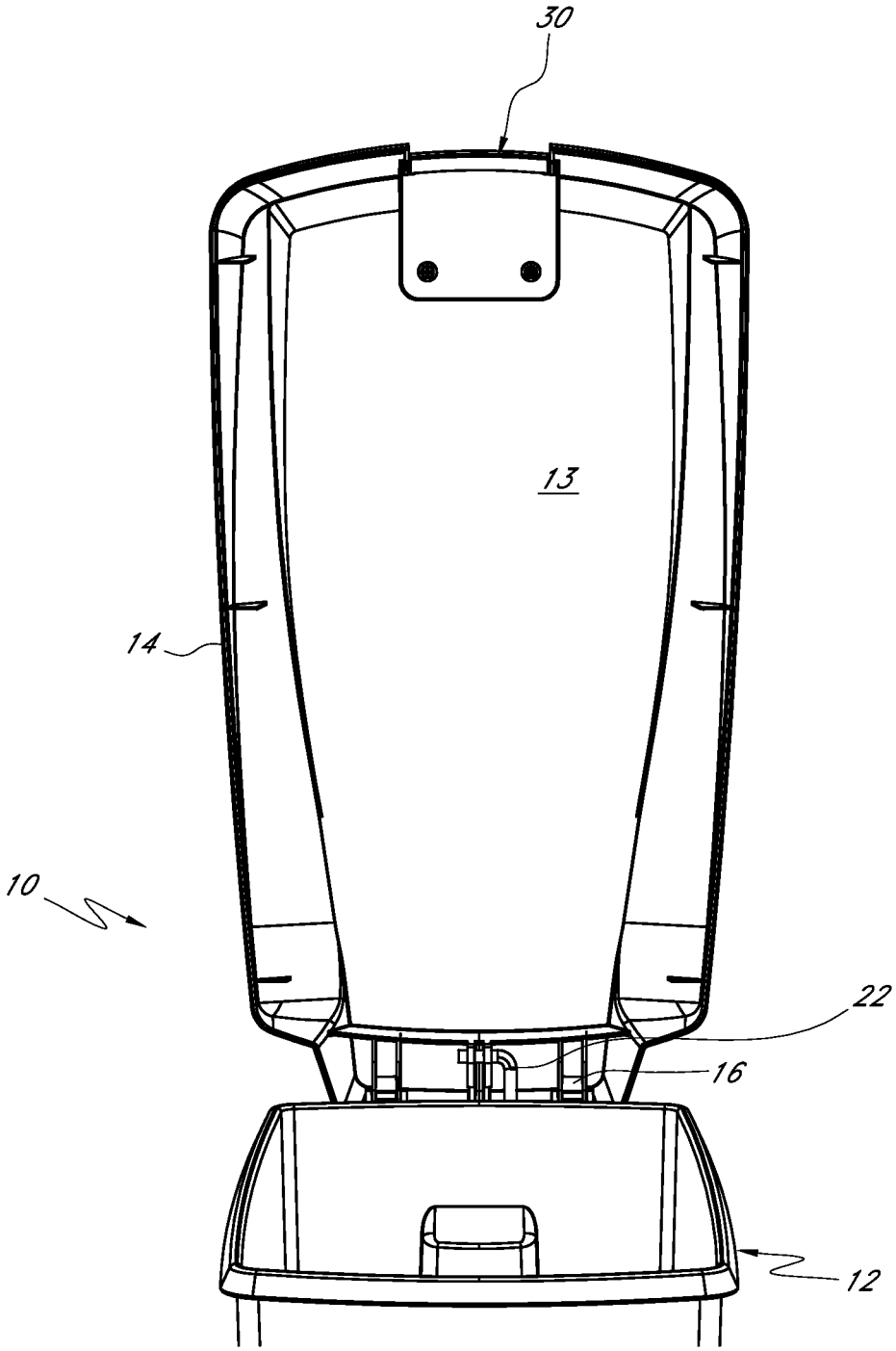
FIG. 16 is a front perspective view of the step trash can with the lid open, showing the underside of the lid with the latch in the lock position.

FIGS. 9, 11, 13 and 15 illustrate the lid latch mechanism 30 in the opened/unlock position. FIGS. 10, 12, 14 and 16 illustrate the lid latch mechanism 30 in the closed/lock position. FIGS. 15 and 16 illustrate the lid 14 opened from the body 12, showing the underside 13 of the lid 14. FIGS. 11 and 12 illustrate in greater detail the sliding movements of the latch 30 with respect to the lid 14. FIGS. 13 and 14 illustrate the top perspective view of the latch 30 with respect to the lid 14. FIGS. 9 and 10 illustrate the sliding movements of the latch 30 with respect to the body 12.

Referring to FIGS. 11, 12, 9A and 10A, the latch 30 can comprise a plate section 32, a bent section 34, and a lip 36. The bent section 34 can be exposed externally, as illustrated in FIG. 13, and can have a profile that is flush with the profile of the adjacent structure of the lid 12, thereby providing an aesthetically pleasing and appealing structure. The plate section 32 can be provided with two slotted holes 38. The plate section 32 can be slidably attached to the underside 13 of the lid 14 near the front edge thereof, by two retaining screws 40 anchored to the underside 13 of the lid 14.

The slotted hole 38 can be sized to allow the screws 40 to slide relatively within the slotted holes 38, thereby allowing the plate section 32 to slide relative to the edge of the lid 14, from the opened/unlock position shown in FIG. 11 to the closed/lock position shown in FIG. 12. Further, at the sides 48 of the bent section 34 of the latch 30 (see FIGS. 9A and 10A), slotted holes 50 can be provided to receive a stub 52 anchored at the adjacent section of the lid 14.

The slotted hole 50 can be sized to allow the stub 52 to slide relatively within the slotted holes 50, thereby further supporting sliding movement of the latch 30 (i.e., the sides 48 of the bent section 34 of the latch 30 to slide relative to the lid 14, from the open unlock position shown in FIG. 9A to the closed/lock position shown in FIG. 10A.

Detents 42*a* and 42*b* can be provided on the edges 41 at the front section of the lid 14. The plate section 32 of the latch 30 has at each side, extending spring tabs 44 that are biased outward away from the plate section 32. The tabs 44 can be provided with a detent with a rounded tip 46 that protrudes and can be received in the indentations 42*a* or 42*b*.

As the plate section 32 slides from an opened/unlock position to a closed/lock position, the tip 46 moves from a lodged position in indentation 42*a* as shown in FIG. 11, to be lodged in indentation 42*b* as shown in FIG. 12, thereby indexing the latch 30 from one position to another. The spring bias in the tab 44 is configured such that sufficient force is applied to lodge the tip 46 in the indentations 42*a* and 42*b* at the respective positions, to securely hold the latch 30 in place at the respective positions.

The periphery of the opening of the body 12 can have an outwardly extending flange or ledge 54. In the open/unlock position shown in FIG. 9A, the lip 36 of the latch 30 is released (i.e., does not catch) from the ledge 54, allowing the lid 14 to be opened with respect to the body 12. In the closed/lock position shown in FIG. 10A, the lip 36 of the latch 30 is latched onto (i.e., catches) the ledge 54, thereby locking the lid 14 against the body 12. Some embodiments, the ledge 54 is formed from an upper portion of the side wall of the body 12. The upper portion can extend hourly from the internal cavity defined by the body 12. Additionally, stiffening ribs (not shown) can extend between the ledge 54 and the outer surface of the body 12 to enhance the stiffness of the ledge 54.

While the above described embodiments are directed to deployment of the inventive latch in a step-type trash container having a pivoted lid, it is understood that the inventive latch can be used in a trash container that has a lid that is not attached to the container body, such as a lid that is removed or separated from the container body when opening the lid.

In some embodiments, the trash can 10 can include a damping mechanism 60 configured to dampen the movement of the lid 14. In some embodiments, the damping mechanism 60 can be disposed at an end of the lever member 24 connecting the pedal 20 with the linkage 22. In some embodiments, the linkage 22 can a lifting rod. The lifting rod 22 can be connected to an end of the lever member 24 that is opposite the pedal 20. As such, when a user depresses the pedal 20, the lever member 24 pivots about a pivot member 62, thereby causing the lifting rod 22 to rise and thereby open the lid 14.

Figure 5:
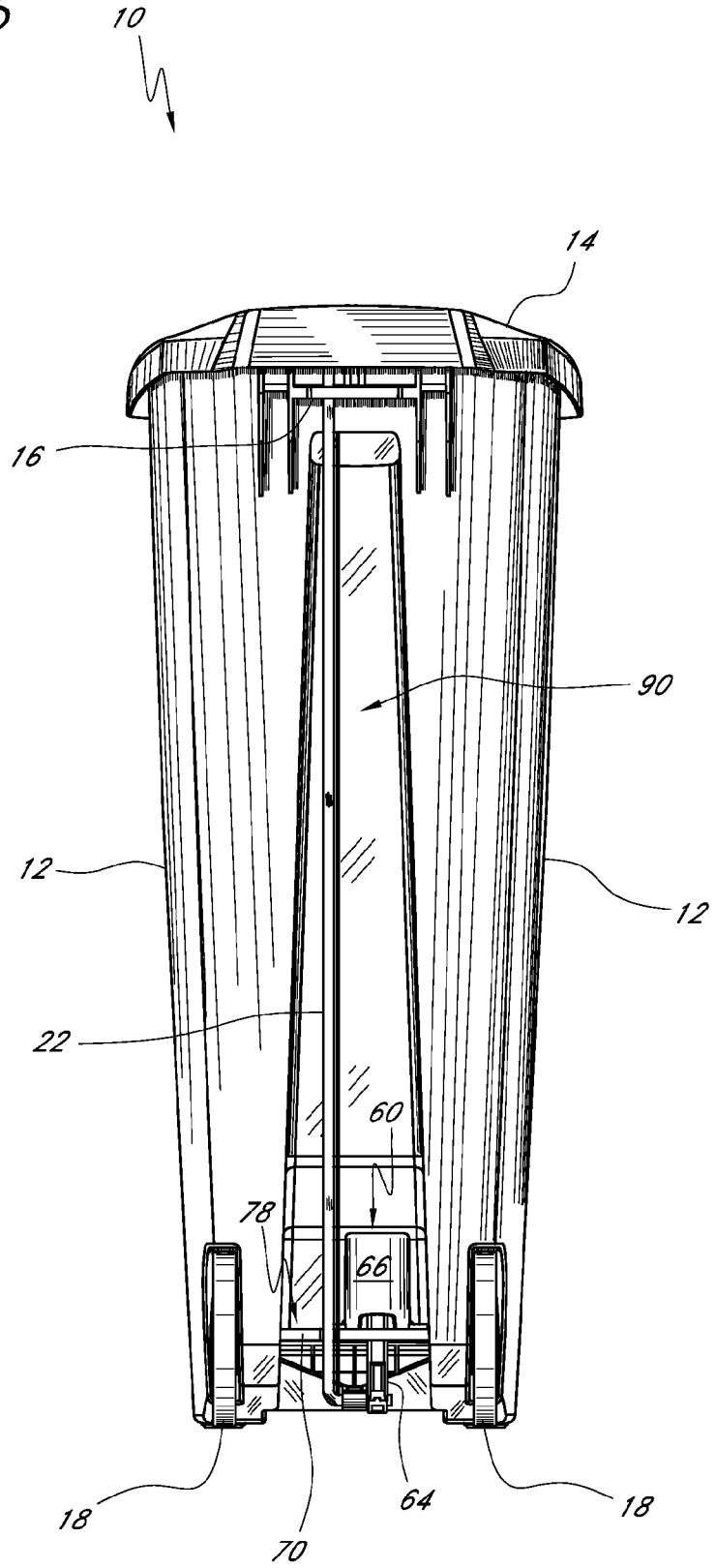
FIG. 5 is a rear view thereof.
Figure 6:
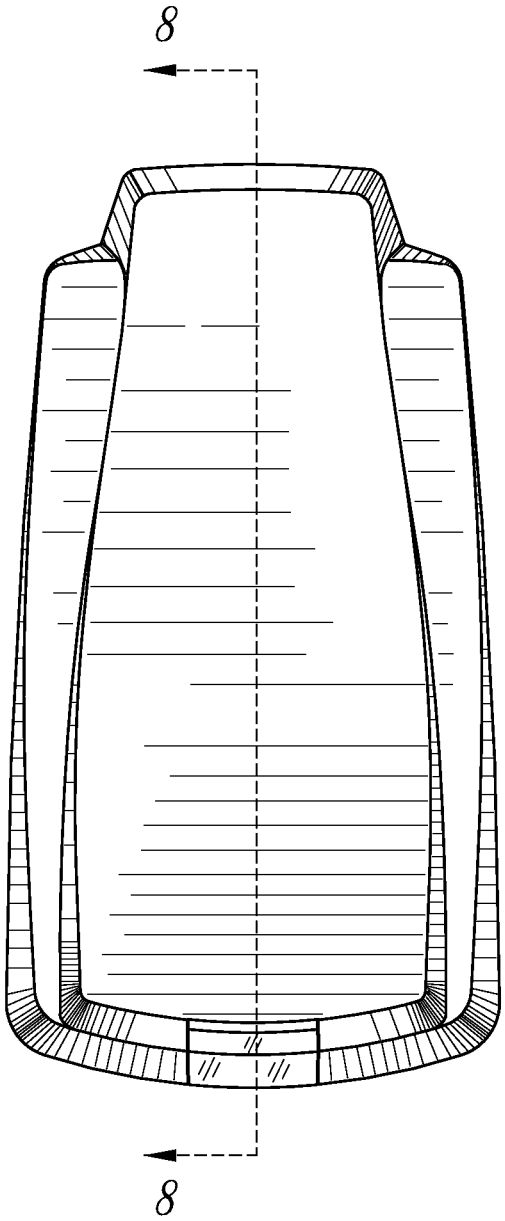
FIG. 6 is a top plan view thereof.

As shown in FIG. 5, the damping mechanism 60 can have a piston rod portion 64 and a cylinder portion 66. The construction and operation of this type of damping mechanism is disclosed in U.S. Patent Publication No. 2007/0012699 which is hereby incorporated by reference. Thus, a detailed description of the damping mechanism 60 is not included herein.

In some embodiments, the lower end of the piston rod 64 is also connected to the end of the lever member 24 that is opposite the pedal 20. In other embodiments, the lower end of the piston rod 64 is connected to an end of the lifting rod 22. As such, when a user steps on the pedal 20, the end of the lever member 24 connected to the lifting rod 22 rises, thereby opening the lid by raising the lifting rod 22, and causing the piston rod 64 to rise, thereby also moving the piston within the cylinder 66. As such, the damping mechanism provides resistance to the upward movement of the lifting rod 22. Additionally, the damping mechanism 60 dampens the movement of the lid toward the closed position by slowing the downward movement of the lifting rod 22. Due to the damping provided by the damping mechanism 60, the damping mechanism itself can experience significant loads.

Figure 17:
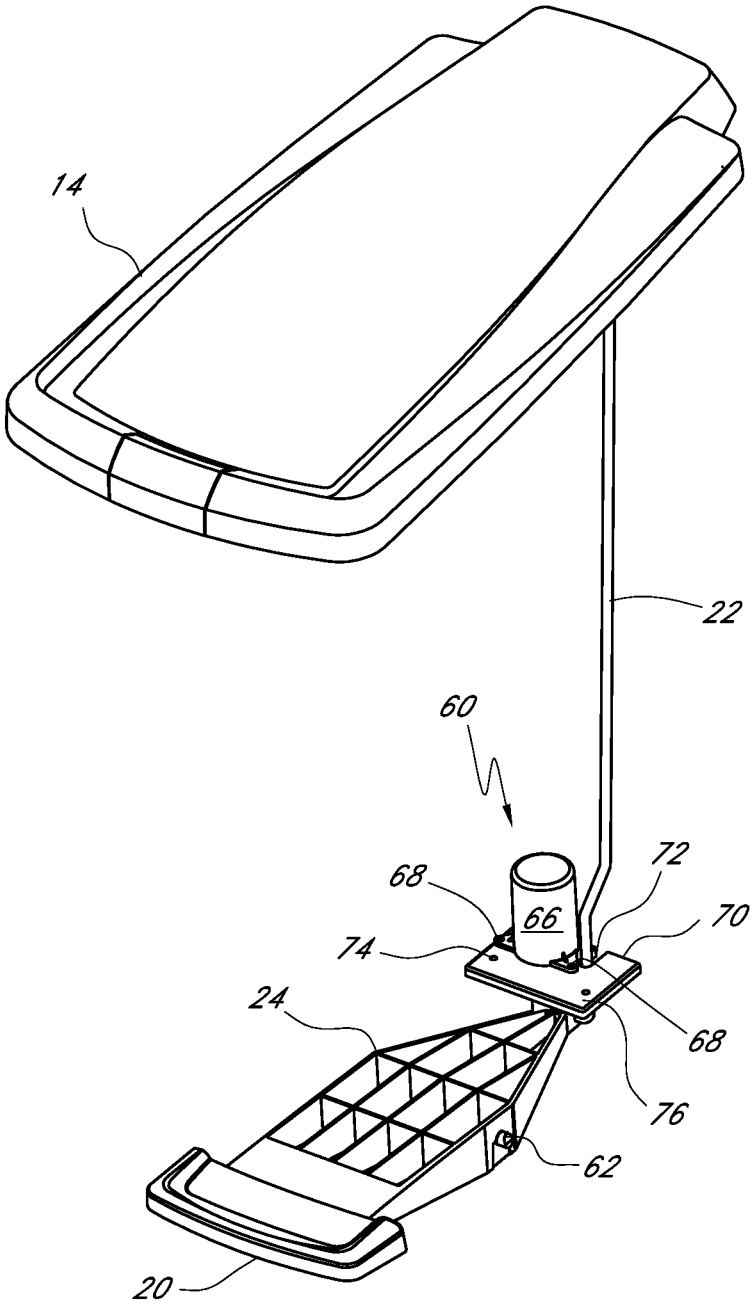
FIG. 17 is another right perspective view of the trash can, with the body and wheels removed.

With continued reference to FIG. 17, a cylinder portion 66 can include a plurality of flanges 68. The mounting flanges 68 can be used to secure the cylinder member 66 in a fixed position relative to the body 12.

Often, the bodies of trash can are made from softer, more malleable plastics, such as high impact polypropylene or other relatively softer plastic materials. However, other hardnesses can also be used.

Thus, because these types of plastics are soft, if the cylinder member 66 is attached directly to the body 12, the cylinder 66 is more likely to move or twist under the loads generated during operation of the pedal 20 and the closing movement of the lid 14. Additionally, such softer materials can fail from fatigue.

Thus, to provide a more secure and reliable attachment of the damping mechanism 62 to the body 12, the trash can also include a mounting platform 70. In some embodiments, the mounting platform can be made from material that is harder than the material used to make the body 12. For example, but without limitation, the mounting platform 70 can be made from Acrylonitrile Butadiene Styrene (ABS) plastic, or other materials.

The mounting platform 70 can include an opening 72 such as a groove or an aperture configured to allow the lifting rod 22 to freely move up and down as the user steps on or releases the pedal 20. Additionally, the cylinder member 66 can be attached to the mounting platform 70 using the flanges 68 and any type of fastener.

The mounting platform 70 can be connected to the body 12 in any known manner. In some environments, the mounting platform 70 can include apertures 74, 76 through which threaded fasteners can extend to attach the platform 70 to the body 12.

Figure 7:
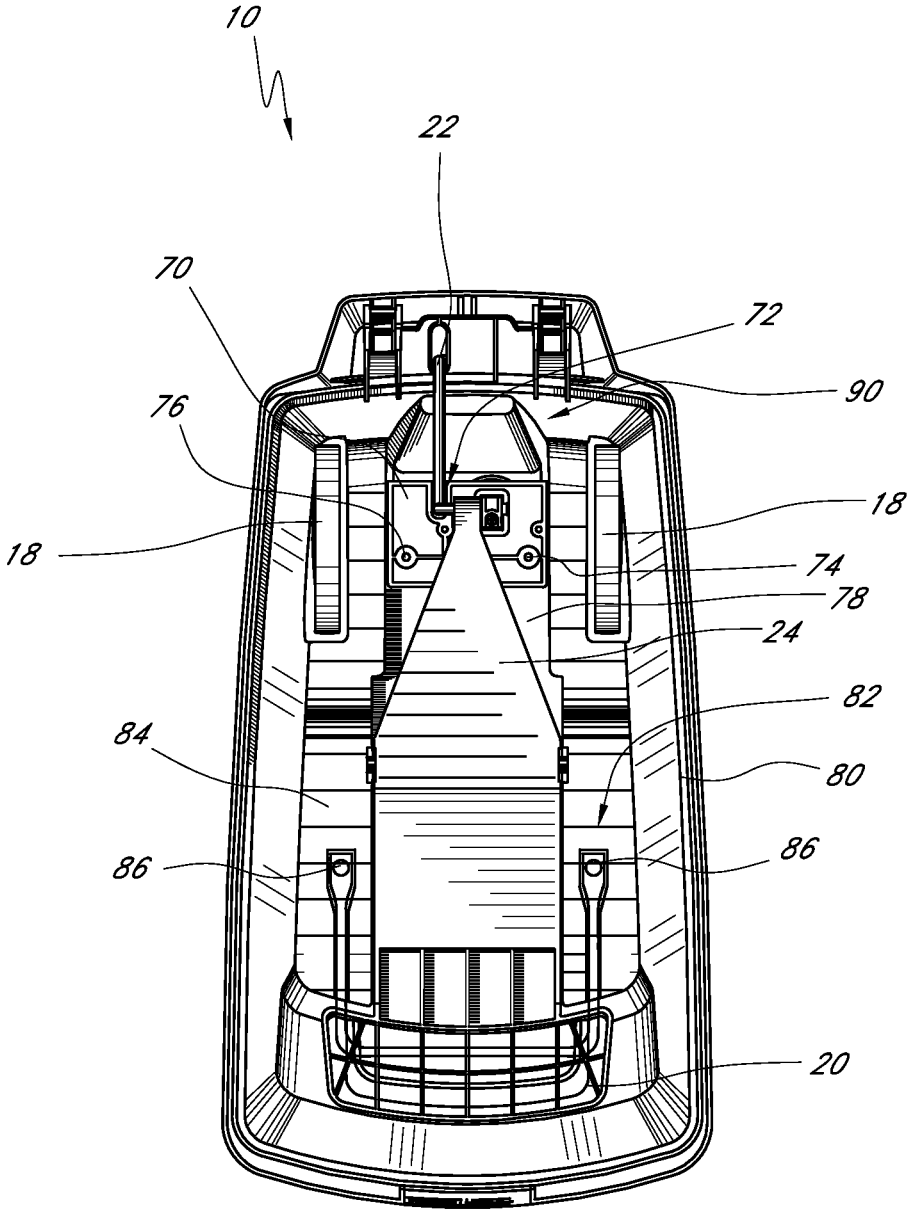
FIG. 7 is a bottom plan view thereof.
Figure 8:
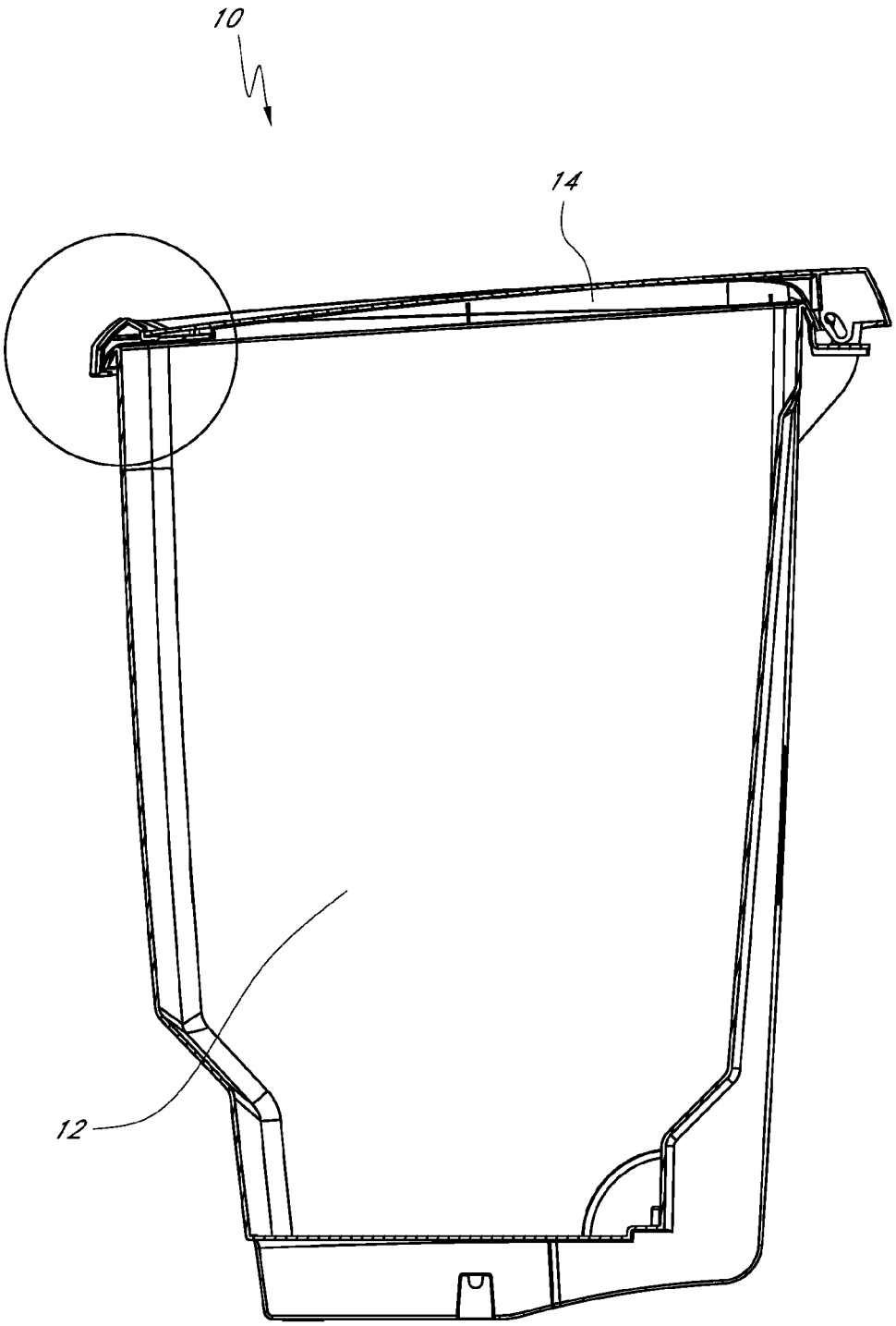
FIG. 8 is a sectional view taken along line 8-8 in FIG. 6.

In some embodiments, the body 12 can include a downwardly facing surface 78 (FIG. 7). The mounting platform 70 can be attached to the downwardly facing surface 78, for example, with fasteners extending through the holes 74, 76. Additionally, the mounting platform 70 can also be glued to the lower surface 78.

With the mounting platform 70 attached to the downwardly facing surface 78, when the pedal 20 is depressed and the lifting rod 22 and the piston rod 64 are raised, all of the associated forces imparted to the mounting platform 70 are transferred to the downwardly facing surface 78 of the body 12. This provides the attachment of the damping member 60 to the body 12 with enhanced strength that can better withstand the forces generated because a user can step on the pedal 20 with all of their weight. Thus, the upward movement of the piston rod 64 can be quite fast, and thus can cause significant forces on the mounting member 70.

When the pedal 20 is released, thereby allowing the lid 14 to close, the lifting rod 22 falls along with the piston rod 64. The devices within the cylinder member 66 slow this movement and thus also in part loads onto the plate 70. These loads are transferred to the body 12 through the fasteners and/or any other attachment means for attaching the plate 70 to the body 12.

In some embodiments where the plate 70 is made from a harder material than that used for the body 12, the plate 70 does not deform as much. Thus, the damping mechanism 60 performs more reliably and consistently.

In some embodiments, the trashcan 10 can be configured to be stackable. For example, the trashcan body 12 can have a tapered shape, expanding outwardly and upwardly. For example, as shown in the front elevational view of FIG. 3 and the right side elevational view of FIG. 4, the outer surfaces of the body 12 can be tapered outwardly and upwardly. As such, with the lid 14 removed, a plurality of the trashcan bodies 12 can be stacked one within another.

With reference to FIG. 7, the trashcan 10 can be configured such that the features near the bottom of the trashcan 10 fall entirely within a footprint of the upper portion of the side wall forming the body 12. For example, as shown in FIG. 7, the pedal 20 and the wheels 18, as seen in a bottom plan view, fall entirely within a periphery 80 defined by an upper portion of the side wall forming the body 12. As such, when one trashcan 10 is stacked within another, the pedal 20 and the wheels 18 can fit within the cavity of another trashcan.

In some embodiments, the trashcan 10 can include a pedal protector 82 (shown in phantom). The pedal protector 82 can be attached to the lower surface 84 of the body 12. In some embodiments, the pedal protector 82 can be fixed to the lower surface 84 with threaded fasteners, such as screws, extending through apertures a six disposed in tens of the protector 82. However, other devices can also be used for fixing the protector 82 to the lower surface 84.

Figure 4:
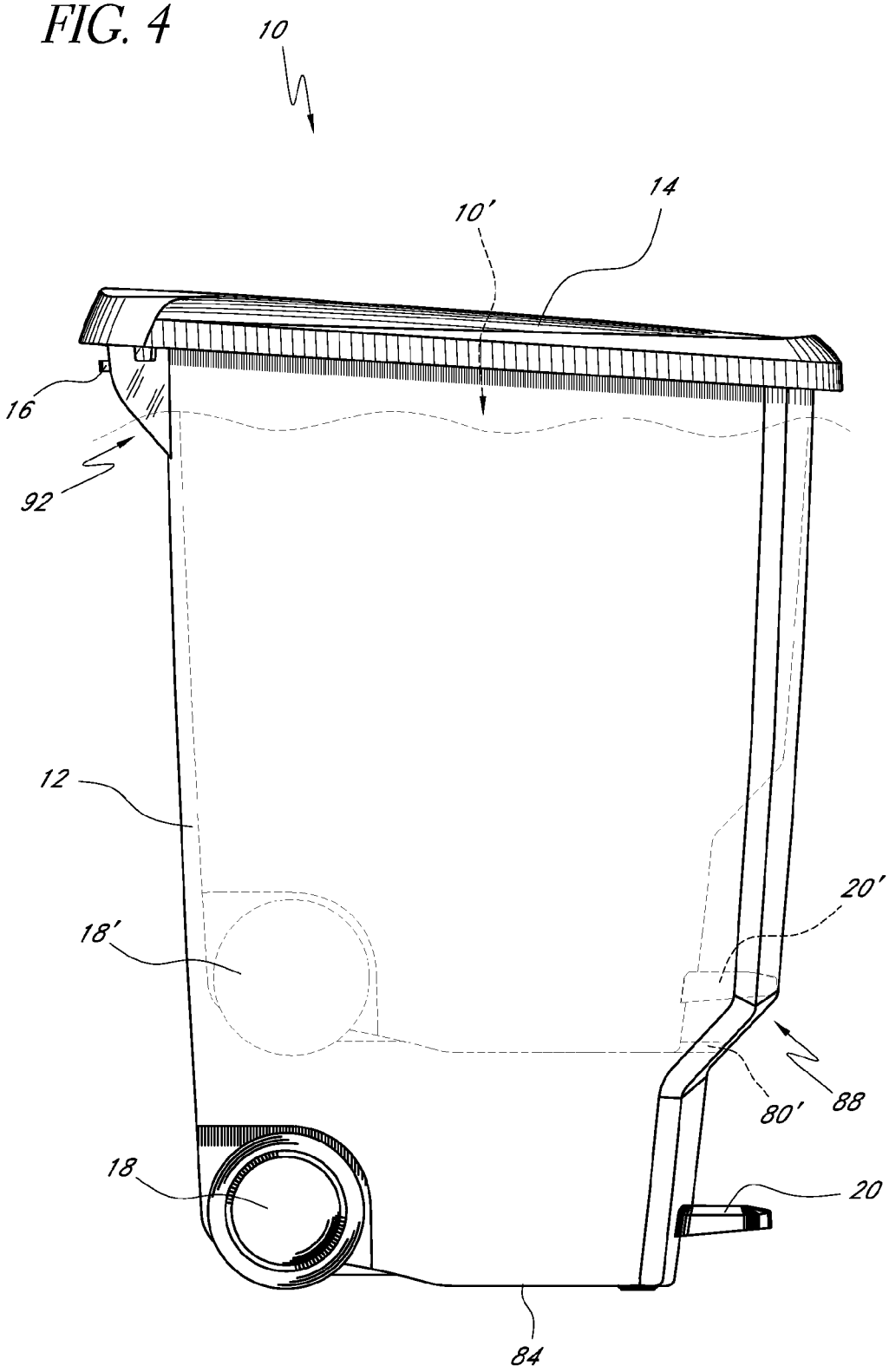
FIG. 4 is a left side view thereof.

The protector 82 can be in the form of a U-shaped bar. Additionally, the lower surface 84 can include a recessed channel (not shown) into which the protector 82 can fit. As shown in FIGS. 4 and 7, the bight of the protector 82 can be positioned so as to extend under the pedal 20. As such, when one trashcan 10' is stacked within another trashcan 10, the protector 80' can prevent the pedal 20' from contacting other portions of the interior of the trashcan 10.

In some embodiments, the trashcan 10 can include a brow portion 88 which extends over the pedal 20. In such embodiments, the interior surface of the brow portion 88, can serve as a resting place for the pedal protector 80' when the trashcan 10' is nested within the trashcan 10.

With continued reference to FIGS. 5 and 7, a rear surface of the body 12 can include a channel 90 configured to receive the lifting rod 22. As such, the lifting rod 22 is better protected when the trashcan 10 is stacked within another.

With reference to FIG. 4, the trashcan 10 can also include a rear projecting portion 92. The rear projecting portion can also help in protecting the lifting rod 22 when the trashcan 10 is stacked within another. For example, the projecting portion 92, when the trashcan 10 is stacked within another, will contact the upper peripheral edge of the body of another trashcan, thereby preventing any portion of the lifting rod 22 from contacting the upper peripheral edge of another trashcan.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A trash container comprising:

a trash can body defining an interior cavity configured to receive trash, the trash can body having an upper opening through which trash can be inserted into the interior cavity;

a lid assembly pivotally attached to the trash can body so as to move between opened and closed positions, the lid assembly comprising:

a lid member sized to cover substantially the entire upper opening of the trash can body, at least a portion of the lid member being spaced from the upper opening when the lid assembly is in the opened position, the lid member covering substantially the entire upper opening when the lid assembly is in the closed position;

a hinge mechanism attached to the lid member and configured to support the entire lid member through pivoted movement of the lid member; and a latch mechanism supported by the lid member, the latch mechanism comprising a slidable latch member mounted so as to be slidable relative to the lid member, the latch member being slidable from a first, locked position in which the latch member engages the trash can body so as to lock the lid assembly in the closed position and a second, unlocked position in which the latch member does not engage the trash can body and the lid assembly is free to pivot to the opened position, the latch member comprising a portion that has a cross-sectional profile that generally corresponds to a cross-sectional profile of the lid member when the latch member is in the second, unlocked position, such that an edge adjacent the latch member on the lid member is positioned at substantially the same outer extent as that of the latch member when the latch member is in the second, unlocked position, and such that outer surfaces of the latch member and lid member are substantially flush with each other along the lid assembly when the latch member is in the second, unlocked position.

2. The trash container according to claim 1, wherein the latch member is integrated with the lid member.

3. The trash container according to claim 1, wherein the latch member is disposed on a front edge of the lid member.

4. The trash container according to claim 1, wherein the lid assembly is attached to the body with the hinge mechanism, the latch member being disposed on a side of the lid member opposite the hinge mechanism.

5. The trash container according to claim 1, wherein the body is made from a first material, and the latch member is attached to the lid member with a mounting member made from a second material that is stiffer than the first material.

6. The trash container according to claim 5, wherein the first material is impact resistant polypropylene and the second material is Acrylonitrile Butadiene Styrene (ABS).

7. The trash container according to claim 6 additionally comprising a pedal actuator configured to move the lid assembly between opened and closed positions, the pedal actuator including a lever member made from ABS and a dampening device mounted to the body with a mounting plate made from ABS.

8. The trash container according to claim 1, further comprises a ledge comprising an upper portion of the trash can body extending outwardly from the internal cavity.

9. The trash container according to claim 1 additionally comprising a pedal actuator assembly comprising a pedal and being configured to raise the lid assembly when the pedal is depressed, and a fixed member extending beneath the pedal.

10. The trash container according to claim 1 additionally comprising:

an opening mechanism configured to move the lid assembly from the closed to the opened position; and a dampening device configured to dampen movement of the lid assembly at least from the opened position toward the closed position, the dampening device comprising a housing mounted to a bottom of the trash can body with a mounting member located between the housing and trash can body, the trash can body made from a first material, the mounting member made from a second material that is stiffer than the first material.

11. The trash container according to claim 10, wherein the first material is impact resistant polypropylene and the second material is ABS.

12. The trash container according to claim 10, wherein the mounting member includes an opening, a portion of the opening mechanism extending through the opening.

13. The trash container according to claim 10, wherein the opening mechanism comprises a pedal assembly and a connector extending between the pedal assembly and the lid member.

14. The trash container according to claim 13, wherein the mounting member includes an opening, the connector extending through the opening.

15. The trash container according to claim 10, wherein the trash can body includes a downwardly facing surface, the mounting member being attached to the downwardly facing surface.

16. The trash container according to claim 10, wherein the housing comprises a cylinder member attached to the mounting member and a piston rod attached to the opening mechanism.

17. The trash container according to claim 10, wherein the opening mechanism comprises a pedal actuator assembly comprising at least a pedal configured to raise the lid when the pedal is depressed, and wherein the trash can further comprises a fixed member mounted beneath the pedal.

18. The trash container according to claim 1, wherein the trash container is pedal actuated.

19. The trash container according to claim 1 additionally comprising:

a pedal actuator assembly comprising at least a pedal configured to raise the lid assembly when the pedal is depressed; and a support member mounted beneath and spaced apart from the pedal, the support member comprising an elongate, cylindrical bar mounted to the lower surface of the trash can body, the elongate cylindrical bar extending away from the trash can body in a generally U-shaped configuration.

20. The trash container of claim 19, wherein the support member is fixed to the lower surface with threaded fasteners extending through apertures in the support member.

21. The trash container of claim 19, wherein the support member is configured to inhibit tipping of the trash can container.

22. The trash container of claim 19, wherein the lower surface comprises a recessed channel in the trash can body, at least a portion of the support member fitted within the recessed channel.

23. The trash container of claim 19 wherein the pedal extends a first distance away from the trash can body and the support member is mounted beneath and spaced apart from the pedal, the support member extending a second distance away from the trash can body, the second distance being less than the first distance.

24. The trash container container of claim 23, wherein the trash can body further comprises a brow portion extending over the pedal actuator assembly.

* * * * *

UNITED STATES PATENT AND TRADEMARK OFFICE

CERTIFICATE OF CORRECTION

PATENT NO. : 8,720,728 B2
APPLICATION NO. : 12/045641
DATED : May 13, 2014
INVENTOR(S) : Yang et al.

It is certified that error appears in the above-identified patent and that said Letters Patent is hereby corrected as shown below:

In the Claims:

In column 9 at line 28, In Claim 24, after “container” delete “container”.

Signed and Sealed this
Twenty-eighth Day of October, 2014

Michelle K. Lee

Michelle K. Lee
*Deputy Director of the United States Patent and Trademark Office*